US006799377B2

(12) United States Patent
Sones

(10) Patent No.: US 6,799,377 B2
(45) Date of Patent: Oct. 5, 2004

(54) APPARATUS FOR GOLF PUTTER FITTING

(76) Inventor: Todd S. Sones, 1688 N. St. Andrews, Vernon Hills, IL (US) 60061

( * ) Notice: Subject to any disclaimer, the term of this patent is extended or adjusted under 35 U.S.C. 154(b) by 0 days.

(21) Appl. No.: 10/796,770

(22) Filed: Mar. 9, 2004

(65) Prior Publication Data

US 2004/0172843 A1 Sep. 9, 2004

Related U.S. Application Data

(62) Division of application No. 10/056,591, filed on Jan. 24, 2002.

(51) Int. Cl.[7] ..... A63B 69/36; G01B 5/00

(52) U.S. Cl. ..... 33/508; 33/419

(58) Field of Search ..... 33/508, 418, 419, 33/427, 452, 464, 465, 472, 473, 474

(56) References Cited

U.S. PATENT DOCUMENTS

| | | | | | |
|---|---|---|---|---|---|
| 776,277 | A | * | 11/1904 | Volberding | 33/472 |
| 964,246 | A | * | 7/1910 | Hagan, Sr. | 33/472 |
| 1,056,917 | A | * | 3/1913 | Len | 33/420 |
| 2,504,244 | A | * | 4/1950 | Barclay | 33/419 |
| 2,820,638 | A | * | 1/1958 | Morrison | 473/252 |
| 3,003,244 | A | * | 10/1961 | Fogliano | 33/341 |
| 3,062,549 | A | * | 11/1962 | Duden | 473/314 |
| 3,208,150 | A | | 9/1965 | Rhodenhamel | |
| 3,953,033 | A | | 4/1976 | Kelly et al. | |
| 3,992,013 | A | | 11/1976 | Golden | |
| 4,104,802 | A | | 8/1978 | Johnston | |
| 4,228,588 | A | * | 10/1980 | Horton, Jr. | 33/1 H |
| 4,562,649 | A | * | 1/1986 | Ciavarella | 33/419 |
| 4,655,457 | A | | 4/1987 | Thompson | |
| 4,866,979 | A | | 9/1989 | Bernhardt | |
| 4,885,847 | A | | 12/1989 | Korfanta | |
| 5,211,400 | A | | 5/1993 | Hall et al. | |
| 5,357,683 | A | * | 10/1994 | Trevino | 33/528 |
| 5,446,969 | A | * | 9/1995 | Terenzoni | 33/419 |
| 5,469,627 | A | | 11/1995 | Denny et al. | |
| 5,616,087 | A | * | 4/1997 | Bothwell | 473/316 |
| 5,665,007 | A | | 9/1997 | Tatum | |
| 5,755,625 | A | | 5/1998 | Jackson | |
| 6,142,884 | A | | 11/2000 | Jin | |
| 6,379,264 | B1 | | 4/2002 | Forzano | |

OTHER PUBLICATIONS

Arm Your Stroke, Sink More Putts, Aug., 1997 Golf Magazine, pp. 80–81.

Choosing the Right Length, Dick's Sporting Goods.com, May 5, 2003, pp. 1–2.

Measuring Instructions for the K'Ching Golf Putter, K'Ching, Apr. 29, 2003, pp. 1–2; Search Results for Jan. 1, 1996–Apr. 29, 2003, pp. 3–4.

* cited by examiner

*Primary Examiner*—Christopher W. Fulton
*Assistant Examiner*—R. Alexander Smith
(74) *Attorney, Agent, or Firm*—Lewis T. Steadman

(57) ABSTRACT

Apparatus for fitting a golf putter club to a golfer comprising a grip supporting a vertical adjustable rod and representing a vertical length A from the upper end of the grip to the ground and having a horizontal beam extending from the rod, on the ground for indicating the distance B from a point directly below the upper and of the grip to the nearest edge of a golf ball positioned for putting, including indicia directly reading the lengths A and B after adjustment of the apparatus.

3 Claims, 2 Drawing Sheets

Fig. 1
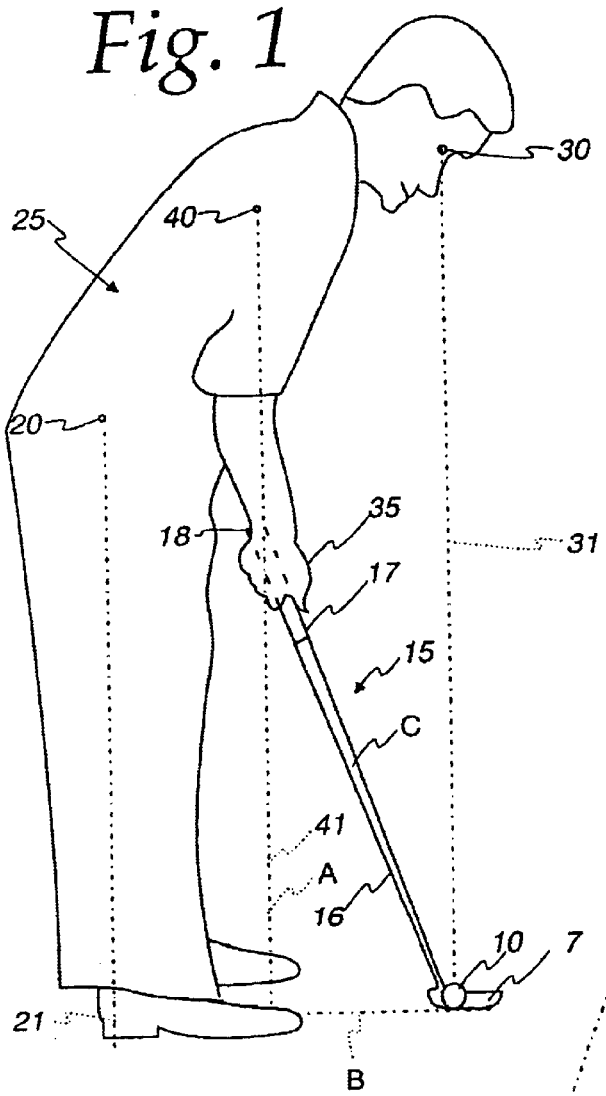
Fig. 2
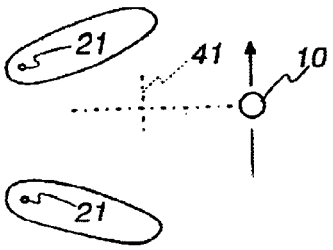
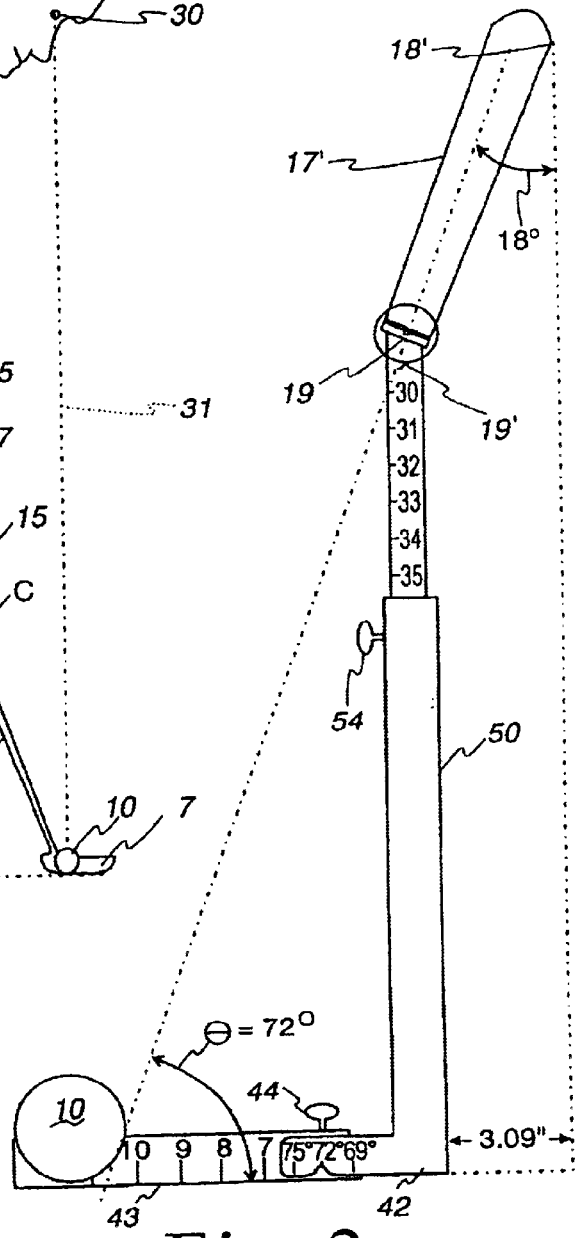
Fig. 3

APPARATUS FOR GOLF PUTTER FITTING

The subject matter of application Ser. No. 10/056,591 is incorporated herein by reference. The present application is a divisional of U.S. application Ser. No. 10/056,591 filed Jan. 24, 2002. The present application claims priority to this previously filed application.

STATEMENT REGARDING FEDERALLY SPONSORED RESEARCH OF DEVELOPMENT

Not applicable.

BACKGROUND OF THE INVENTION

The sport of golf has become an increasingly popular sport in the last few decades. This popularity has increased for many reasons, but perhaps two of the most important are the rise of a number of very charismatic internationally recognized stars, and the availability of extremely good television coverage of the many events. Much of the tension, and excitement, of any golf tournament, surrounds the act of putting, which in the final analysis, ordinarily determines the ultimate winner of any tournament. The importance of putting, in the game of golf, is readily understood when it is noted that for a standard 18 hole golf course having a par rating of 72, 36 of those strokes are allocated to putting, two strikes for each green, or putting surface. This truism is reflected, as well, in the timeless golfism "drive for show; putt for dough."

As a result of its obvious importance to successfully playing the game of golf, the art, or skill, of putting has been the subject of large numbers of instruction manuals, books, magazine articles, and, indeed, United States patents. A casual observation of professional and amateur golfers, in the acts of putting shows that putting style, including putter grip, player's stance, putter club style, ball position, etc. is different, and, perhaps, unique, for each golfer. Physically, golfers vary greatly in height and weight, and also vary in the distance between the ground and the golfer's hands, where the golfer is standing erect. Generally speaking, the act of putting does not require unusual strength, or extremely high velocity club swinging, as in the case of driving or iron play. Putting is, rather, an act of finesse and, hopefully, an act as free of physical stress and mental swing correction signals as possible.

Golf clubs available for purchase at most sports stores are readily available in varying degrees of shaft flex and club head shape. The length of the woods and irons of a set of golf clubs are usually approximately standard throughout the golf manufacturing industry, although such clubs may be special ordered with non-standard lengths. Most golfers, however, acquire a standard length set of clubs and modify their stance, grip, and other swing characteristics to optimize their swing action relative to those clubs. In the case of putters, conventional practice is to provide putters having an overall length of 35", and a conventional lie angle between the shaft and the bottom surface of the putter approximating 70°. Rarely are putters shortened or lengthened, and my experience indicates that the casual beginner, or intermediate, golfer will adapt his putter swing to the length of the club rather than having a putter personally fitted to him, or her, without any reference to the standard length or lie.

It will be noted that the mere act of providing fitting clubs with adjustable shaft lengths and/or adjustable lie angles, has been long known in the golf business. For example, Johnston, U.S. Pat. No. 4,104,802; Rhodehamel, U.S. Pat. No. 3,208,150; Kelly U.S. Pat. No. 3,953,033; Thompson, U.S. Pat. No. 4,655,457; Korfanta, U.S. Pat. No. 4,885,847; and Denny U.S. Pat. No. 5,469,627. While these patents and other known club fitting methods and devices provide club fitting techniques that include club length adjustment and club lie adjustment, they do not properly establish the proper length and/or lie of a putter club that is optimum for a given individual player. For the most part, players are commonly asked what length of putter feels comfortable to them. Unfortunately, what is comfortable to an individual is what that individual has done in the past, which very often is not correct.

SUMMARY OF THE INVENTION

In accordance with the present invention, the ultimate length and lie of the putter club are established by first defining the best set-up position for each individual player. Once that correct set-up has been established, and a correct-length putter is fitted, the putter should also be manufactured with the correct, or optimum, swing weight, and overall club weight to maintain the proper balance of the putter club and provide proper player feel of the putter club throughout the player's putting stroke. In accordance with the present invention, for each individual player, the correct, optimum, set-up position for executing a putting stroke, entails three vertical indicator lines. The first line extends from the ball directly vertical, where it should intersect the player's eyes. The second is a vertical line through the shoulder sockets with the hands and arms directly thereunder, elbows slightly bent. The third line extends vertically through the hip sockets and the heels of the player. In the proper aligning condition, the players hips are positioned comfortably directly over the heels of the feet, the torso is tilted forwardly about the hip sockets until the arms hang freely straight downwardly from the shoulders and forward of the legs, permitting free swinging motion of the arms to the left and right of the torso, and with the player's eyes directly above the golf ball. I recommend placing the hands on the club grip in the palms, rather than at the base of the fingers, thereby generally aligning the club shaft and the arms. This set-up properly positions the hands and club for an optimum, repeatable, natural, free swinging putting stroke motion.

The length of the putter club is then determined for that individual player by measuring the distance from the heel of the palm, at the natural wrist crease, of the left hand (in the case of right handed golfer) and the ground directly below the hands, and the distance from the point on the ground directly below the noted hand crease to the inside edge of the golf ball (i.e., the edge facing the golfer). The Pythagorean Theorem thereupon establishes the proper length of the putter shaft, and trigonometric rules establish the correct lie angle for the putter head, and swing weight of the club can be chosen. As is well known in the art, when a club is shortened from it's initially manufactured condition, if nothing else is changed, the swing weight, or feel of the club decreases. Accordingly, a standard 35" putter that has been shortened by several inches, will feel considerably lighter during the swing. In accordance with my preferred fitting method, the swing weight of about D-0 is chosen and the weight of the putter club head and/or the weight of the grip is preferably adjusted to provide that optimum swing weight.

DESCRIPTION OF THE DRAWINGS

FIG. 1 is an elevational view of a golfer from the golfer's right side illustrating a proper set-up in accordance with the invention;

FIG. 2 is a plan view taken along line II—2 of FIG. 1;

FIG. 3 is a side elevation of a tool conveniently used with the method of the invention.

DETAILED DESCRIPTION OF THE PREFERRED EMBODIMENTS

Figure 4:
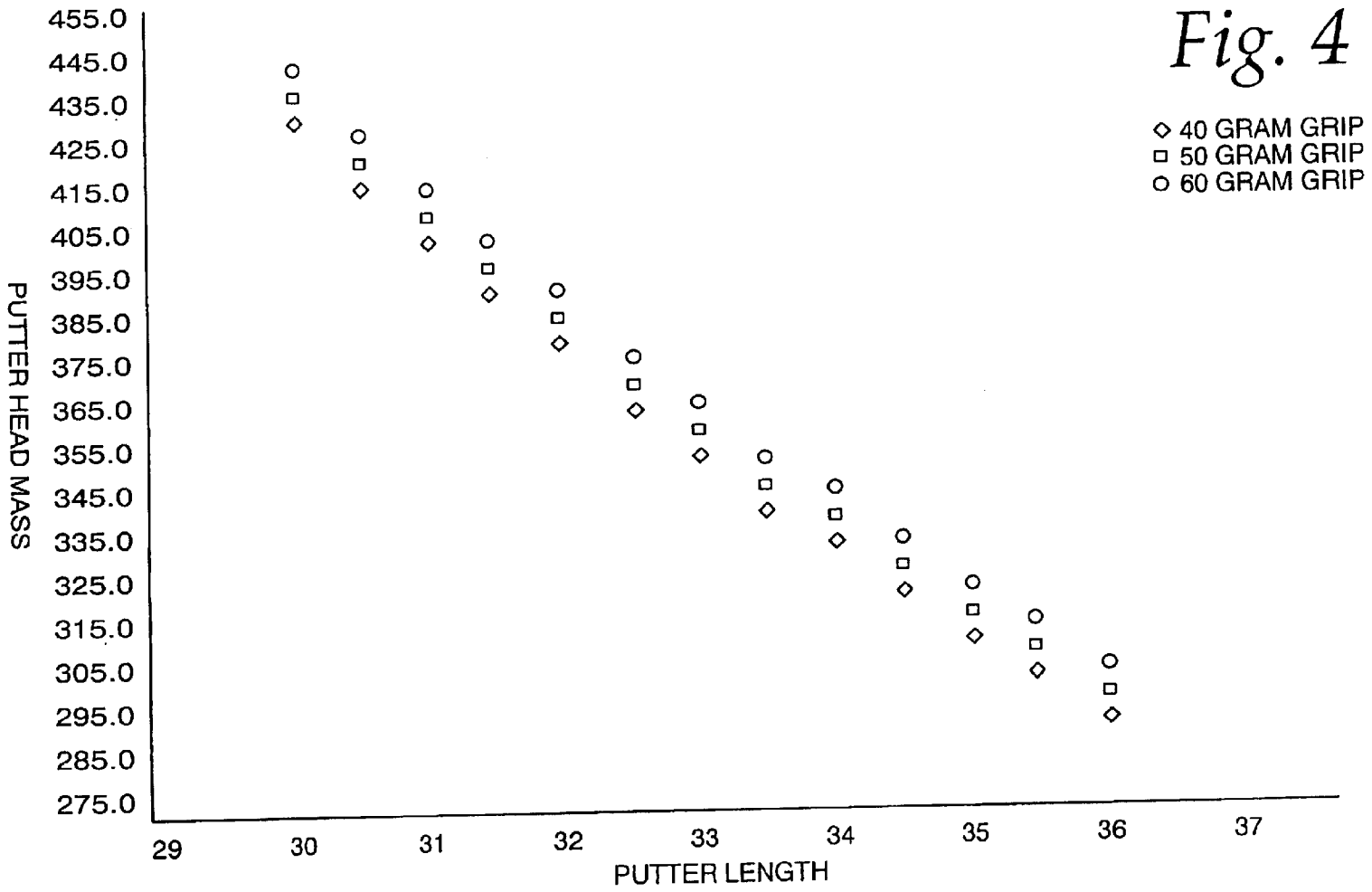
FIG. 4 is a chart illustrating club head mass, in grams, variation with variation in club length in inches and grip weight in grams, but without variation in swing weight.

FIG. 1 is a view of a golfer as seen from his right side looking toward a golf hole into which the golfer expects to putt the golf ball 10 using the putter 15 having a shaft 16 and a putter blade 17. In FIG. 1, the golfer is standing on the green with the ball 10 positioned between his feet approximately as illustrated in FIG. 2. The golfer is shown positioned in an optimum state for putting. As can be seen, the golfer's hip sockets generally indicated at 20 are positioned directly above the golfer's heels indicated at 21 to provide optimum stability. The golfer's torso 25 is tilted forwardly, generally about the hips 20 until the golfer's eyes 30 are directly vertically above the ball 10, on vertical line 31, and the golfer's hands 35 are positioned directly below the shoulder sockets 40, along line 41 and are positioned in front of and somewhat spaced from the golfer's legs so that swinging motion of the arms in the vertical plane parallel to the line of ball movement and including line 41 is free from interference with the golfer's legs and abdomen. In this condition, it will be observed that the line 41 intersects the ground at a distance B from the ball 10, and the upper end 18 of the shaft 16, and grip 17 is at a distance A above the ground.

In the condition illustrated there, it will be seen that the appropriate length of the putter from the upper end of the grip to the bottom of the blade 17 is equal to the hypotenuse of the right triangle formed by legs A, B and C and, accordingly, according to the Pythagorean Theorem, the length C can be accurately determined by the formula $A^2+B^2=C^2$ An important aspect of the present invention is the fitting concept that the dimension of the shaft C is determined after the golfer is in the optimum, preferred position, rather than providing the golfer with an adjustable length club and suggesting that he, or she, adjust the length until it feels "most comfortable." In fact, when a golfer assumes the optimum position for putting, as herein described, it may very well feel uncomfortable to him or her until substantial practice has occurred, swinging the putter of the proper length, many times. I have found in practice, and in teaching many professional and amateur students that, in fact, the classical 35" standard length putter is usually longer than the proper length determined under my system.

The lie angle θ varies with the trigonometric formula tan θ=A/B; where θ is 72° tan θ is 3.08. The lie angle θ may, accordingly, be found from the standard natural trigonometric functions table or a standard engineering slide rule.

A suitable fitting tool using the theorem noted above is shown in FIG. 3. There, the vertical, telescoping arm 50 is adjustable in length by wing screw clamp 54, and grip 17' is likewise adjustable at pivot 19 to provide a grip of variable angle. As illustrated, the 10" long grip is at 18° from the vertical, complimentary of the 72° lie angle considered standard. At 18°, the end 18' of the grip is 3.09" inside the adjustable vertical arm 50 (sin 18°=3.09"/10") and, accordingly, the measuring rule 43 on horizontal arm 42 has the starting indication of 7" at 3.91" from the inside edge of arm 42. The rule 43 is adjustable along arm 42 using wing screw 44 to compensate for a change of measurement from 18°±3° which varies the length 3.09" from 3.58" to 2.59, i.e., plus or minus ½ inch. In use, the grip 17" may be adjusted at 18° from vertical, to reflect 72° lie, which shows on the indicator 19' as 72° after the proper set up, described above, is determined, the tool is adjusted to provide the desired shaft length. At this point, the final lie angle will be determined from the measurements A and B. That angle may then be set at the grip indicator 19 and rule 43 by wing screws 19 and 44 respectively. The final measurement may be confirmed by renewing the set up position with the hands in position and the arm 42 lying on the ground behind the ball. In the case of using an adjustable length and lie tool described, in connection with FIG 1, the foremost consideration in proper fitting, is to assume the correct putting position as described, and then determine the putter length and lie for that position, whether or not the golfers initial reaction is one of comfort. Comfort will come with practice, and the results will justify the adoption of the proper length and lie specified here.

My method of fitting can also be implemented by providing a dozen, or so, different putters having different lengths and lies, again making the solution based upon the proper set up described. This technique allows incorporating the appropriate head weight and grip weight coupled with the individual club shaft length, along with instruction regarding optimum clubs wing weight and balance.

It is noted, of course, that the length and lie fitting club can be similar to that shown in Johnston U.S. Pat No 4,104,802 but only when the adjustment of length is short enough and lie is made to fit the hand and ball positions for optimum putting noted above (i.e. the club is fitted to the proper golfer position without regard to adjustment of the golfer to any particular club length and/or lie.)

As is well known in the art of golf club manufacture, the "Swing Weight" is an industry standard for measuring the balance point or feel of the club head as it swings. Ordinarily, Swing Weights of the individual clubs of a set are preferably approximately the same, with a Swing Weight of D-4 representing a head-heavy swing feeling and a Swing Weight of C-8 having a head-light feeling. Typically, clubs of standard manufacture in current times will be Swing Weighted in the range D-0 to D-2. I have found that the preferred swing weight of a putter is in the range C-8 to D-0 for the average golfer.

While the feel that is most comfortable to a golfer may vary somewhat with the individual golfer, the important aspect from the point of view of adjusting putter length, is that shortening a 35" putter of a standard Swing Weight D-0, for example, will, without any other change, substantially decrease the Swing Weight of the putter club. Under these circumstances, when a shortened, perhaps 32" , putter is used by a golfer, it will feel unduly light. While the Swing Weight of a putter can be accommodated by many golfers, it is preferred that the club head of the putter be adjusted by adding weight, and/or the grip lightened, when the putter is shortened, so that the resulting club still swings approximately at the same Swing Weight as the remaining clubs in the golfer's set. This relationship is shown in FIG 4 which illustrates the way that head weight varies with club length and/or grip weight. The chart illustrates a club having a swing weight of D-0. If a lower swing weight of C-8, for example, is desired, the head weight will be lower.

Various other modifications and changes are contemplated and may be resorted to without departing from the scope of the invention as set forth in the hereinafter appended claims.

I claim:

1. A measuring apparatus for determining appropriate putter length for fitting a golf putter club to a golfer, said apparatus comprising:

a grip, a vertical, adjustable rod supported by said grip with an axis of said grip at an angle to the rod and representing a length A from an upper end of the grip to the ground, a horizontal beam extending from the rod and located adjacent the ground for indicating a distance B from a point directly below the upper end of the grip to a predetermined point on the horizontal beam, said predetermined point aligned with the axis of said grip, said vertical rod and said horizontal beam including scales directly reading the lengths A and B after adjustment of the apparatus.

2. Apparatus according to claim 1 wherein said grip is adjustably pivoted about an upper end of the vertical rod and the length of said horizontal beam is adjustable relative to the vertical rod to reflect a change in the angle between the grip and vertical rod.

3. Apparatus according to claim 1 wherein said predetermined point is at an edge of a golf ball positioned adjacent said horizontal beam.

* * * * *